US008400060B2

(12) United States Patent
Arimoto et al.

(10) Patent No.: US 8,400,060 B2
(45) Date of Patent: Mar. 19, 2013

(54) SHORT ARC TYPE DISCHARGE LAMP

(75) Inventors: Tomoyoshi Arimoto, Himeji (JP); Mitsuru Ikeuchi, Himeji (JP); Akihiro Shimizu, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/245,028

(22) Filed: Sep. 26, 2011

(65) Prior Publication Data

US 2012/0081002 A1 Apr. 5, 2012

(30) Foreign Application Priority Data

Oct. 1, 2010 (JP) ..... 2010-223930

(51) Int. Cl.
*H01J 17/04* (2012.01)

(52) U.S. Cl. ..... 313/633; 313/631; 313/632; 313/574; 313/622

(58) Field of Classification Search ..... 313/631–633, 313/574, 622
See application file for complete search history.

(56) References Cited

U.S. PATENT DOCUMENTS

| | | | | |
|---|---|---|---|---|
| 2006/0220559 | A1* | 10/2006 | Ikeuchi | 313/633 |
| 2007/0228982 | A1* | 10/2007 | Morimoto et al. | 313/633 |
| 2010/0045185 | A1* | 2/2010 | Kitagawa et al. | 313/632 |
| 2010/0244689 | A1* | 9/2010 | Kagebayashi et al. | 313/632 |

FOREIGN PATENT DOCUMENTS

JP 2010-33825 A 2/2010

* cited by examiner

*Primary Examiner* — Mary Ellen Bowman
(74) *Attorney, Agent, or Firm* — Roberts Mlotkowski Safran & Cole, P.C.; David S. Safran

(57) ABSTRACT

A short arc type discharge lamp wherein a cathode and an anode are arranged opposite to each other in an interior of a light emitting tube and said cathode consists of a main body part with tungsten as the main constituent and an emitter part comprised of thoriated tungsten, wherein an oxygen content of the main body part of said cathode is lower than that of the emitter part, and band-shaped tungsten carbide is formed at the tip end face of the emitter part of said cathode.

7 Claims, 2 Drawing Sheets

SHORT ARC TYPE DISCHARGE LAMP

BACKGROUND OF THE INVENTION

1. Field of the Invention

The present invention relates to short arc type discharge lamps and relates specifically to short arc type discharge lamps wherein an emitter part containing thorium oxide is provided at the cathode.

2. Description of Related Art

As short arc type discharge lamps containing mercury have a short distance between the tip ends of a pair of electrodes arranged oppositely to each other in a light emitting tube and are close to point light sources, they are conventionally used for the light source of exposure devices with a high focusing efficiency by means of a combination with an optical system. Further, short arc type discharge lamps containing xenon are used as light sources for visible light in projectors etc., and recently, they are also used as light sources for the digital cinema.

Among these short arc type discharge lamps, lamps are known which are designed to increase the electron emission characteristics by providing an emitter material at the cathode. In this regard, recently, limitations have been established for the use of thorium being an emitter material from the aspect of savings in the scarce resources of rare earth elements, and there is the demand to avoid the usage of large quantities thereof. Additionally, there is also the fact that thorium is a radioactive substance and the handling thereof is restricted by legal regulations.

With regard to these circumstances various discharge lamps have been developed which are configured such that the emitter material is contained only in the tip end part of the cathode. In JP-A-2010-33825, the configuration of the cathode of such a known short arc type discharge lamp is disclosed. FIG. 4 illustrates this conventional technique wherein FIG. 4(*a*) is a general view of the short arc type lamp and FIG. 4(*b*) shows the configuration of the cathode thereof As shown in FIG. 4(*a*), an anode 11 and a cathode 12 made from tungsten are arranged opposite to each other in the interior of a light emitting tube 10 of a short arc type discharge lamp 1. A light emitting substance such as mercury or xenon is enclosed in said light emitting tube 10. In this drawing, a condition is shown where the short arc type discharge lamp 1 is lighted vertically, but depending on the usage there are also lamps which are lighted horizontally. The configuration of the cathode in this lamp is shown in FIG. 4(*b*). The cathode 12 consists of a cathode main body part 12*b* made from high purity tungsten and an emitter part 12*a* formed integrally therewith. As to this emitter part 12*a*, an emitter substance such as, for example, thorium oxide has been introduced into tungsten. When thorium is used for the emitter substance in this kind of lamps, the thorium oxide contained in the thoriated tungsten of the tip end part of the cathode is reduced to thorium atoms by means of the development of a high temperature at the cathode surface, diffuses at the outer surface of the cathode, and migrates to the tip end side where the temperature is high. By means of this, the work function can be decreased and the electron emission characteristics can be improved.

In the above mentioned example of the prior art, however, the emitter substance contributing to the improvement of the electron emission characteristics is actually limited to the emitter substance contained within a very shallow region from the outer surface of the cathode tip end. Originally, the emitter substance evaporates at the outer surface of the cathode tip end because of the heat and is consumed, but it is expected that emitter substance will be supplied because of the concentration diffusion from the interior of the cathode. But there is the phenomenon that the supply because of the concentration diffusion from the interior of the cathode having a lower temperature becomes insufficient as compared to the amount being consumed at the outer surface where the temperature is highest, and that the supplied quantity cannot reach the consumed quantity. Thus, even if a large quantity of the emitter substance is contained in the interior of the cathode, the phenomenon arises that there is a shortage of the emitter substance at the surface of the cathode. Therefore, with the above mentioned known technique there is the problem that although an emitter substance is contained in the cathode tip end, this emitter substance is not utilized sufficiently, and when the emitter material at the cathode tip end surface is depleted, the electron emission characteristics decrease and flicker occurs.

SUMMARY OF THE INVENTION

In view of the above-mentioned problems of the known technique, this invention has the object to provide a short arc type discharge lamp wherein a cathode and an anode are arranged opposite to each other in the interior of a light emitting tube and said cathode consists of a main body part with tungsten as the main constituent and an emitter part at the tip end of said main body part and consisting of thoriated tungsten, wherein a shortage of the emitter substance at the cathode surface is avoided by means of aiming at an effective utilization of the emitter substance being contained in the inner portion of the cathode tip end, the electron emission characteristics are maintained for a long time despite the reduction of the use level of the emitter substance because this reduction is compensated by a sufficient utilization of the emitter substance, and an extension of the flicker durability of the lamp is intended.

The above object is solved by short arc type discharge lamp wherein a cathode and an anode are arranged opposite to each other in an interior of a light emitting tube and said cathode consists of a main body part with tungsten as the main constituent and an emitter part comprised of thoriated tungsten, wherein an oxygen content of the main body part of said cathode is lower than that of the emitter part, and band-shaped tungsten carbide is formed at the tip end face of the emitter part of said cathode.

Further, in a preferred embodiment, a carbide layer is formed at the side face of said cathode.

In another preferred embodiment, the emitter part is bonded to a tip end of said main body part.

In yet another preferred embodiment, the main body part and the emitter part of said cathode are diffusion-bonded.

In still another preferred embodiment, the main body part of said cathode is comprised of pure tungsten.

In still another preferred embodiment, the main body part of said cathode consists of doped tungsten containing a metal oxide.

Preferably, the metal oxide is an oxide of at least one of thorium, cerium, rhenium and lanthanum.

As, according to the present invention, tungsten carbide is formed at the tip end face of the emitter part containing thorium oxide, carbon (C) from the carbide phase diffuses into the interior of the cathode, that is, into the interior of the emitter part, the reduction reaction of the thorium oxide in the emitter part is promoted and the thorium oxide contained in the interior of the cathode is utilized effectively. Because the oxygen generated in the emitter part because of the reduction reaction of the thorium oxide diffuses rapidly into the cathode main body part with a low oxygen concentration, the reduction reaction of said tungsten oxide in the emitter part is promoted even more in conjunction with said diffusion effect of carbon. As a result, a depletion of the thorium oxide at the surface of the cathode emitter part does not occur and a lamp with long flicker durability can be implemented despite of the limitations in the use of the emitter substance.

DETAILED DESCRIPTION OF THE INVENTION

Figure 1:
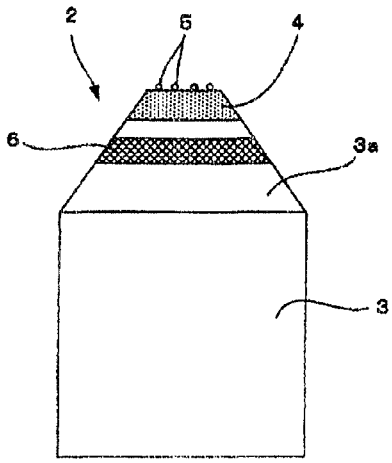
FIG. 1 is a schematic overall view of the configuration of the cathode of a discharge lamp according to the present invention.

FIG. 1 shows the configuration of the cathode being used in the short arc type discharge lamp of this invention. The cathode 2 consists of a main body part 3 with tungsten as the main constituent and an emitter part 4 having been bonded to the tip end thereof As to the method for bonding said main body part 3 and the emitter part 4, for example welding, brazing, friction welding or diffusion bonding can be employed. But among these bonding methods the utilization of diffusion bonding is particularly preferred. Here, diffusion bonding means a solid-phase bonding wherein metals are arranged on top of each other and are heated and pressed in the solid state below the melting point of said metals so that no plastic deformation occurs, and the atoms of the bonded part are diffused. Because the heating temperature in the process of this diffusion bonding amounts to approximately 2000° C. and it is not necessary to heat up to the melting temperature of tungsten (approximately 3400° C.) such as in the process of fusion bonding, the metal structure of the main body part 3 and of the emitter part 4 can be maintained and there is no detrimental influence on the performance of the cathode. Further, because the metal structure of the cathode does not change, there is also the advantage that a cutting process can be performed also after the bonding of the main body part 3 and the emitter part 4.

Said main body part 3 consists of pure tungsten with a purity of, for example, 99.99 wt. %, while the emitter part 4, for which thorium oxide ($ThO_2$) as the emitter substance has been incorporated into tungsten being the main component, is made of so-called thoriated tungsten (in the following also referred to as thoriated tungsten). The thorium oxide content amounts to, for example 2 wt. %. Normally, the thorium oxide being contained in the thoriated tungsten which makes up the emitter part 4 is reduced to thorium atoms by means of reaching a high temperature during the lighting of the lamp and is diffused at the outer surface of the cathode and migrates to the tip end side where the temperature is high. By means of this, the work function can be decreased and the electron emission characteristics can be improved.

Further, a portion 3*a* with a reduced diameter consisting of a taper shape wherein the diameter becomes smaller towards the tip end side is formed at said main body part 3, and the frustoconically shaped emitter part 4 is bonded to the tip end thereof. By means of this the tip end of the cathode 2, as a whole, is given the shape of a truncated cone consisting of a taper shape. However, the shape of the portion 3*a* with a reduced diameter of said main body part 3 is not limited to this tapered shape and may also be an arcuate shape, and also the tip end of the emitter part 4 may have a so-called bullet-shaped arcuate shape. Further, it is shown that the emitter part 4 is bonded to the portion 3*a* with a reduced diameter of the main body part 3 but depending on the overall shape of the cathode it may also be bonded to the columnar portion of the main body part 3.

Figure 2A:
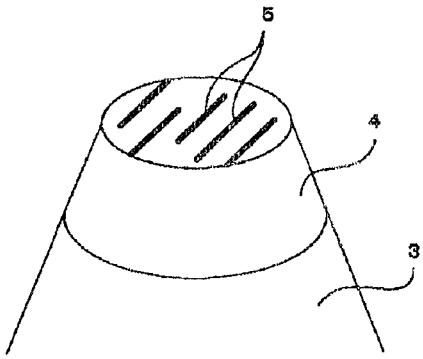
FIG. 2 is a schematic oblique view of the upper part of the cathode of FIG. 1.
Figure 2B:
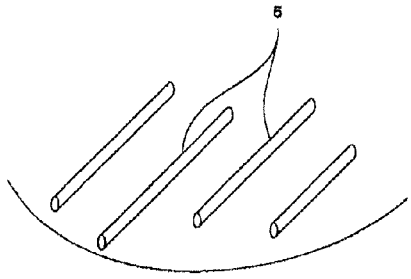

As is shown in detail in FIGS. 2(*a*) and 2(*b*), band-shaped tungsten carbide 5 is formed in the tungsten (W) phase at the surface layer of the tip end face of the emitter part 4 of said cathode 2. Further, a carbide layer 6 is formed at the side face of the portion 3*a* with a reduced diameter of said cathode main body part 3.

Figure 3:
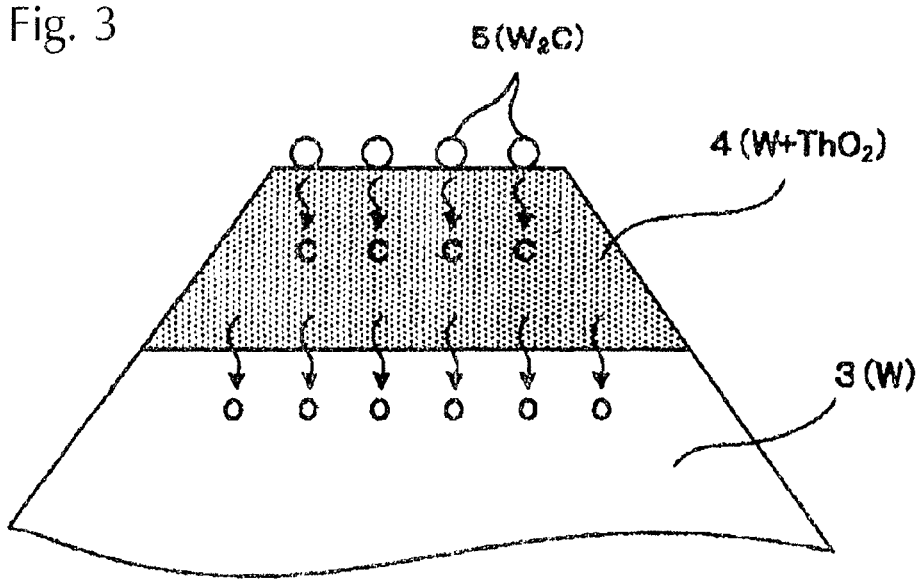
FIG. 3 is an explanatory view of the effects of the cathode of the present invention.
Figure 4A:
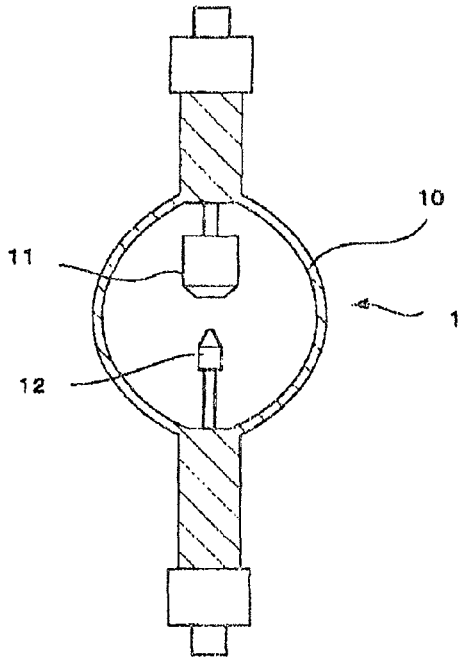
Fig. 4(a) (Prior Art)
FIG. 4(*a*) is a schematic overall view of a known discharge lamp, and FIG. 4(*b*) shows the configuration of the cathode thereof.
Figure 4B:
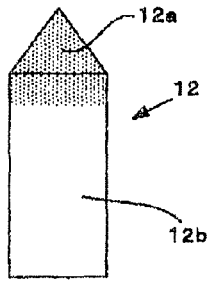
Fig. 4(b) (Prior Art)

To explain the effects thereof using FIG. 3, during the lighting of the lamp a reduction reaction with the carbon (C) solidly dissolved in the tungsten (W) occurs at the surface of the thorium oxide ($ThO_2$) in the thoriated tungsten making up the emitter part 4, thorium (Th) is formed and at the same time carbon monoxide (CO) is generated.

$$ThO_2+C \leftrightarrows Th+2\ CO \quad (1)$$

The carbon monoxide generated by means of this reduction reaction solidly dissolves in the surrounding tungsten.

$$CO \leftrightarrows [C]w+[O]w \quad (2)$$

Now, [C]w is the carbon solidly dissolved in the tungsten, and [O]w is the oxygen solidly dissolved in the tungsten. That is, for the promotion of said reduction reaction it is necessary that carbon (C) is present in the vicinity of the thorium oxide, and it is necessary that the generated carbon monoxide (CO) is removed. As, here, tungsten carbide ($W_2C$) 5 is formed at the tip end face of the cathode 2 and the cathode tip end part reaches a high temperature during the lighting of the lamp, carbon (C) solidly dissolves with a high concentration in the tungsten and diffuses from the surface layer portion into the interior of the emitter part 4 of the cathode and is supplied to the thorium oxide surface. By means of this the quantity of the carbon being supplied to the thorium oxide surface is increased and the reduction reaction of the thorium oxide shown by the above formula (1) is promoted.

Because, additionally, in the present invention the emitter part 4 consisting of thoriated tungsten is present at the main body part 3 with tungsten as the main constituent, it is thought that the reduction reaction of the thorium oxide is promoted even further by means of the mechanism described below. As is shown by formula (2), the CO generated by means of the reduction reaction (1) of the thorium oxide decomposes to C and O and solidly dissolves in the tungsten and dissipates from the vicinity of the thorium oxide into the tungsten by means of a concentration diffusion. As a result, the pressure of CO at the surface of the thorium oxide decreases and therefore said reduction reaction proceeds. As in the interior of the emitter part 4 [C]w and [O]w dissipate from the thorium oxide ($THO_2$) particles which are dispersed in the tungsten, the concentrations of [C]w and [O]w in the tungsten become approximately uniform. As a result, the concentration diffusion of [C]w and [O]w from the vicinity of the thorium oxide is suppressed. But as in the cathode 2 of the present invention the main body part 3 made from pure tungsten is bonded to the emitter part 4, a concentration gradient of [O]w between said emitter part 4 and the main body part 3 becomes possible (the concentration in the main body part 3 is lower), and on the basis thereof the dispersion of [O]w from the emitter part 4 to the main body part 3 because of a concentration diffusion is stimulated. Because, as a result, the concentration of [O]w in the vicinity of the thorium oxide in the emitter part 4 decreases, the solid dissolution reaction of O increases as is shown by formula (2), and the pressure of CO decreases. By means of this the reduction reaction of the thorium oxide of formula (1) in the emitter part 4 is promoted. Now, because the temperature in the vicinity of the bonding part becomes higher with the proximity of the bonding part of the emitter part 4 and the main body part 3 to the cathode tip end, in other words, the shorter the emitter part 4 is, and the diffusion of [O]w is stimulated, it is thought that the above mentioned dissipation of [O]w into the main body part 3 becomes fast and the reduction of the thorium oxide in the emitter part is promoted.

Now, said main body part 3 is not limited to pure tungsten but may also be comprised of a material with a lower oxygen concentration than that of the emitter part 4, that is, so-called doped tungsten containing an oxide of thorium, cerium, rhenium, lanthanum or another metal. As also in such a case the oxygen concentration of the main body part 3 is lower than that of the emitter part 4, a dissipation of oxygen from the emitter part 4 to the main body part 3 occurs, and there is also the advantage that the mechanical processing of the main body part 3 becomes easy.

Because, as was described above, according to present invention the supply of C to the surface of the thorium oxide contained in the emitter part 4 is increased together with a stimulation of the dissipation of [O]w from said emitter part 4, the reduction reaction (1) of the thorium oxide is promoted.

Now an example for producing the cathode of the present invention will be explained. Rods of thoriated tungsten with a diameter of 10 mm and a thickness of 5 mm and pure tungsten with a diameter of 10 mm and a thickness of 20 mm are prepared. Next, the joint faces of the thoriated tungsten and the pure tungsten are fit together and an axial compressing pressure of about 2.5 kN is applied in a vacuum. Then, the temperature of the joint portion is brought to approximately 2000° C. by heating by means of applying a current and the thoriated tungsten and the pure tungsten are diffusion bonded for about 5 minutes. By means of a cutting process of the material after the diffusion bonding, a cathode 2 the tip end of which being the emitter part 4 (thoriated tungsten) and the rear being the main body part 3 (pure tungsten) is obtained.

Next, a tungsten carbide layer 6 with a thickness of approximately 30 μm is provided by means of a carburizing process at the surface of the cathode 2 with the exception of the tip end part, concretely at the surface of the cathode 2 at a position being, for example, retracted backwards from the tip end face for at least about 2 mm along the axial direction.

Now, in this embodiment an example is shown wherein the tungsten carbide layer 6 is formed at a position remote from the emitter part 4, but it may also be positioned such that a part thereof covers the emitter part 4. The position of such a coverage is decided by the quantity of carbon being evaporated by the temperature, as will be explained below.

During the lighting of the lamp carbon monoxide (CO) is formed from the water vapor ($H_2O$) released from the inner surface of the light emitting tube, the oxygen (O) released from the electrodes and the carbon (C) of the tungsten carbide layer 6. A part of this CO enters the arc by means of diffusing in the gaseous state in the interior of the light emitting tube. This CO is decomposed in the arc because of the high temperature and $C^+$ ions are formed. These $C^+$ ions are transported to the cathode tip end surface by means of the electrical field in the arc, and a part thereof solidly dissolves in the tungsten, or it reacts there with the tungsten so that a carbide 5 of tungsten such as $W_2C$ or WC is formed, is exposed to the high temperature of the cathode tip end face and melts.

The quantity of this carbon having been solidly dissolved in the tungsten or this carbide of tungsten is very low, for C was introduced from the gaseous phase. The carbide via the molten state forms a stripe-shaped pattern in the form of a plurality of bands of a carbide 5 of tungsten at the cathode tip end face of the tungsten when the lamp is extinguished, as the quantity of C supplied to the cathode tip end face is low. Then, also a part of the C having been solidly dissolved in the tungsten during the lighting of the lamp becomes a carbide of tungsten and precipitates at the cathode tip end face while the lamp is extinguished because the solubility limit decreases with the decrease of the temperature, but as the quantity of this C is low, it forms a plurality of bands of a carbide 5 of tungsten similar to the carbide via the molten state.

The reason for the necessity of forming band-shaped phases of tungsten carbide at the cathode tip end face is that because the cathode tip end surface reaches a high temperature of approximately 2900° C., the cathode would be worn off, the light emitting tube would be blackened and the intensity of the emitted light would decrease and the end of the service life would be reached at an early stage if tungsten carbide with a low melting point were present in a quantity to cover the tip end face. The fact that the tungsten carbide layer 6 is formed at the surface with the exception of the tip end part of the cathode bases on the same reason.

The band-shaped phases 5 of carbide formed at the cathode tip end face can be controlled by the position of the provision of the tungsten carbide layer 6. This means that because the generation of CO is stimulated the higher the temperature of the position of the provision of the tungsten carbide layer 6 becomes (with the proximity to the tip end of the cathode), the transported quantity of C increases, and if it becomes too large no formation of bands but a formation at the whole area of the cathode tip end face occurs, and by a melting of the tungsten carbide an undesired deformation of the cathode tip end is induced.

The carbon source for supplying C via the gaseous phase to the cathode tip end face is not limited to a tungsten carbide layer at the cathode surface, and it is also possible to provide a tungsten carbide layer at the surface of the anode or to provide a solid carbon body in the light emitting tube. Dependent on the lamp it may also be possible not to provide a separate carbon source such as was mentioned above but to have the carbon contained in the tungsten making up the cathode as the carbon source, and in such a case the carbon from the cathode surface becoming CO and being supplied in the gaseous phase is utilized.

Details of the band-shaped tungsten carbide having been formed as described above are shown in FIG. 2, wherein FIG. 2(*a*) is an enlarged oblique view of the tip end part and FIG. 2(*b*) is an again enlarged view thereof. Concretely, as is shown in the drawings, the carbide of tungsten forms band-shaped phases by being generated in a plurality of stripes side by side on the tungsten (W) phase being the main constituent of the cathode tip end part. These band-shaped phases 5 of a carbide of tungsten have a width of approximately 0.1 to 0.5 μm, and the plurality of phases is formed with a spacing of approximately 0.5 to 3 μm.

The proportion of the carbon at the cathode tip end amounts to approximately 1 wt. %, and the proportion of carbon is highest at the surface layer of the cathode tip end and decreases with the retraction of the position from the tip end. This, of course, confirms that the carbon has been transported to the tip end of the cathode in the gaseous phase.

Because, as was mentioned above, according to the present invention a carbide of tungsten is formed at the tip end face of the cathode, the quantity of carbon being supplied to the thorium oxide in the interior of the emitter part of the cathode increases, the reduction reaction of the thorium oxide in the emitter part is promoted and the thorium oxide present in the interior of the emitter part can be made to function effectively. Therefore, not only the thorium oxide at the surface part of the emitter part can be used effectively and a short service life because of a depletion of the emitter substance can be avoided. Further, because the solidly dissolved oxygen generated by said reduction reaction is concentration-diffused from the emitter part to the main body part, said reduction reaction is promoted even further in conjunction with said supply of carbon. Thus, a cathode configuration being able to also fulfill the social demand of limiting the use level of the emitter substance can be implemented, and as to the concrete configuration, despite the configuration where the emitter part is bonded at the portion with a reduced diameter of the cathode main part, the function to avoid flicker can be brought forth for a sufficiently long time.

What is claimed is:

1. A short arc type discharge lamp wherein a cathode and an anode are arranged opposite to each other in an interior of a light emitting tube and said cathode consists of a main body part with tungsten as the main constituent, an electrode rod on an end of which the main body part is supported and an emitter part comprised of thoriated tungsten, the emitter part being at an end of the main body part opposite the electrode rod, wherein an oxygen content of the main body part of said cathode is lower than that of the emitter part, and band-shaped tungsten carbide is formed at a tip end face of the emitter part of said cathode facing the anode.

2. The short arc type discharge lamp according to claim 1, wherein a carbide layer is formed at a peripheral side face of said cathode.

3. The short arc type discharge lamp according to claim 1, wherein the emitter part is bonded to a tip end of said main body part.

4. The short arc type discharge lamp according to claim 3, wherein the main body part and the emitter part of said cathode are diffusion-bonded.

5. The short arc type discharge lamp according to claim 1, wherein the main body part of said cathode consists of pure tungsten.

6. The short arc type discharge lamp according to claim 1, wherein the main body part of said cathode consists of doped tungsten containing a metal oxide.

7. The short arc type discharge lamp according to claim 6, wherein the metal oxide is an oxide of at least one of thorium, cerium, rhenium and lanthanum.

* * * * *